United States Patent [19]

Suganuma

[11] 4,255,804

[45] Mar. 10, 1981

[54] ELECTRONIC WATCH

[75] Inventor: Kunio Suganuma, Tokorozawa, Japan

[73] Assignee: Citizen Watch Company Limited, Tokyo, Japan

[21] Appl. No.: 880,592

[22] Filed: Feb. 23, 1978

[30] Foreign Application Priority Data

Mar. 1, 1977 [JP] Japan ..... 52-21998

[51] Int. Cl.[3] ..... G04C 19/00

[52] U.S. Cl. ..... 368/84; 368/82; 368/239; 368/242; 340/784; 340/752

[58] Field of Search ..... 58/23 BA, 50 R, 152 R, 58/23 R; 340/784, 752; 73/6; 368/82, 84, 239, 242

[56] References Cited

U.S. PATENT DOCUMENTS

| | | | |
|---|---|---|---|
| 3,937,049 | 2/1976 | Murakami et al. | 73/6 |
| 3,946,591 | 3/1976 | Yanagawa et al. | 73/6 |
| 3,998,044 | 12/1976 | Yamanchi et al. | 58/23 R |
| 4,044,546 | 8/1977 | Koike | 58/23 R X |
| 4,106,283 | 8/1978 | Yamashita | 58/152 R |

*Primary Examiner*—Ulysses Weldon

*Attorney, Agent, or Firm*—Sherman & Shalloway

[57] ABSTRACT

An electronic watch adapting a matrix drive display system. An electronic watch comprises a single voltage level power source serving as the energy source for a circuit of the watch, a matrix drive type liquid crystal display device providing digital indications of times by means of line and column electrodes, a crystal oscillator producing a time reference signal, a frequency divider circuit dividing said time reference signal into time unit signals, a time keeping counter counting the time unit signals to provide a time keeping signal, matrix drive circuit means converting said time keeping signal into drive signals for said line and column electrodes and pitch measurement signal transmission means act on the matrix drive circuit means to momentarily supply at least some of the wave forms of outputs of the time line and column electrode drive signals.

6 Claims, 8 Drawing Figures

ELECTRONIC WATCH

BACKGROUND OF THE INVENTION

1. Field of the Invention

This invention relates to matrix drive display electronic timepieces and more particularly to a matrix drive display electronic timepiece which can reliably deliver a pitch measuring signal.

2. Description of the Prior Art

An electronic timepiece operative to count a frequency of a crystal oscillator and digitally display the numerical values thus counted as the time with the aid of an electronic-optical display of a liquid crystal display device or the like having a selective pattern of numerals has been well known. It has also been well known that a display pattern drive for an electronic-optical display device such as a liquid crystal display device or the like is composed of a so-called static drive and matrix drive. The matrix drive is also called as a dynamic drive. In the static drive, one of a pair of transparent electrodes for respective segments between which is sandwiched a liquid crystal layer of a liquid crystal cell is integrated into one common electrode to which is applied a rectangular voltage wave having a given frequency of several tens of Hz, while the other transparent electrode constitutes a display pattern connected to a terminal. To non-display segments is applied a voltage wave which is the same in amplitude and phase as the voltage wave applied to the common electrode and to display segments is applied a voltage wave which is opposite in phase to the voltage wave applied to the common electrode. As a result, only those liquid crystal substrate layers which correspond to the display segments are brought into a drive electric field.

In the matrix drive, one of the pair of transparent electrodes for respective segments is not made integral into one common electrode, but is divided into several electrodes which are called column electrodes. Segment electrodes constituting display patterns are not separated from each other and that segment electrode which corresponds to each column electrode is assembled together into a group of electrodes which are called line electrodes.

The voltage wave applied to the column electrode is so shaped that only those segment groups which belong to one column are simultaneously displayed and that this display condition is revealed at each column at a high cycle in a time separation manner.

The voltage wave applied to the line electrodes is made different in accordance with those elctrodes which are disposed on the column electrodes and which are to be driven.

The liquid crystal layer functions in substantially dependence with the effective value (root mean square value) of a driving voltage difference wave form. This behavior of the liquid crystal substance is utilized so that a effective voltage value larger than a threshold value required for displaying segments is selectively applied to that liquid crystal portion which corresponds to the segments to be displayed and so that a effective voltage value smaller than the threshold value is selectively applied to that liquid crystal portion which corresponds to the segments to be extinguished. In general, the voltage wave form applied to the column or line electrodes is a complex stepshaped waveform which is composed of a combination of several predetermined voltage levels.

A drive means for a liquid crystal display electronic wrist watch, which has heretofore been used in practice, comprises an electric source circuit and a drive circuit which is simple in construction and which is not required to be operated in a highly stable manner, and as a result, makes use of the static drive which can easily select the liquid crystal substance and which permits allowances for the precision required for working the liquid crystal display cell.

The matrix drive provides the important advantage that the total number of electrode terminals led out of the display device is about one-half that of the static drive and hence the connection thereof to the drive circuit becomes simplified, thereby reducing the manufacturing cost of the timepiece, improving the reliability of operation and rendering it possible to display a letter composed of many segments, and characters having a number of figures. As a result, if the technical level of manufacturing the circuits and liquid crystal cell becomes high, the matrix drive would be used in practice in near future. It has been the common practice to use the matrix drive for the liquid crystal of an electronic table computer.

Even in the electronic wrist watch, it is necessary to check its pitch at any desired time for the maintenance purposes. In this case, it is preferable to deliver a pitch signal without opening a cover of the watch. In conventional liquid crystal display time-pieces, provision is made of a metal plate adjacent to a viewing crystal provided at a display surface and a slight voltage change induced by the static drive is amplified so as to prepare a pitch signal.

On the contrary, in the matrix drive, if use is made of the above mentioned technique, a pitch measuring instrument becomes erroneous in operation owing to unstable detection levels and low sensitivity caused by complex voltage wave forms for transferring a number of voltage levels at a high speed, and by a small number of segments which are the same in voltage wave form and the like.

SUMMARY OF THE INVENTION

An object of the invention, therefore, is to provide a matrix drive display electronic timepiece which can eliminate the above mentioned drawback which has been encountered with the conventional technique, i.e., which can deliver a pitch measuring signal in a reliable manner.

A feature of the invention is the provision of a matrix drive display electronic timepiece comprising:

(a) a crystal oscillator for generating a time reference signal;

(b) a frequency divider circuit for dividing the frequency of said time reference signal to produce a time unit signal;

(c) a time counter for counting said time unit signal to produce a time counting signal;

(d) a line electrode driver for receiving the time counting signal from said time counter;

(e) a timing pulse generation circuit connected between said frequency divider circuit and said line electrode driver;

(f) a multi-level voltage converter connected in parallel with said timing pulse generation circuit between said frequency divider circuit and said line electrode driver;

(g) a column electrode driver connected to said multi-level voltage converter;

(h) a gate means for receiving the outputs from the said line electrode driver and from the column electrode driver;

(i) means for obtaining a logic product by multiplying the input to and output from the multi-level voltage converter and delivering the logic product to the gate means; and (j) a transmitter means for delivering to the gate means a voltage having a simplified wave form whose frequency corresponds to a pitch of said timepiece.

BRIEF DESCRIPTION OF THE DRAWINGS

The invention will now be described in greater detail with reference to the accompanying drawings, wherein.

DETAILED DESCRIPTION OF THE PREFERRED EMBODIMENTS

Figure 1:
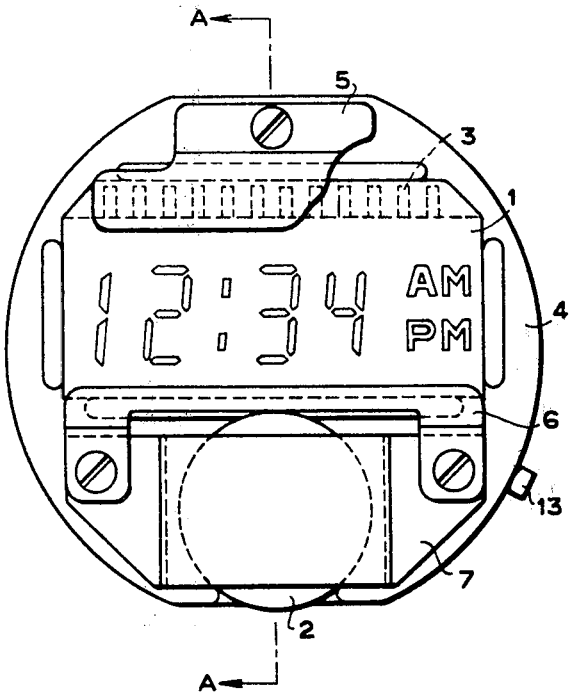
FIG. 1 is a front elevational view of one embodiment of a matrix drive display electronic timepiece according to the invention.
Figure 2:
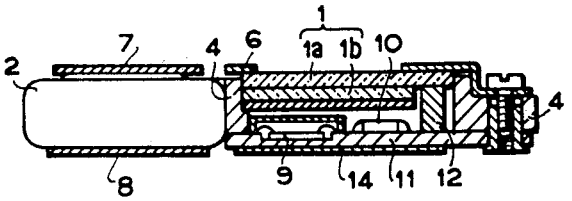
FIG. 2 is a cross-sectional view taken along a line A—A of FIG. 1.

FIG. 1 is a front elevational view of one embodiment of a wrist watch movement according to the invention and FIG. 2 is its cross-sectional view. FIGS. 1 and 2 show a liquid crystal display cell 1 composed of an upper substrate 1*a*, a lower substrate 1*b* with a liquid crystal substance sandwiched between these substrates 1*a*, 1*b*, an electric source battery 2, display electrode terminals 3 belonging to a group of display pattern driving electrodes provided at the lower surface of the upper substrate 1*a*, a holder 4 formed of plastics, etc. and mounted thereon all elements for the movement 5, display cell holding plates 6, electric battery holding plates 7, 8 an integrated circuit chip 9, another mounting member 10, a circuit substrate 11 having a wiring pattern formed thereon and for coupling electronic-parts, and a multi-contact connector member12 for connecting the circuit to the display electrode terminal 3.

In the construction shown in FIGS. 1 and 2, the display cell 1 and electric battery 2 are arranged side by side, so that it is possible to provide a timepiece having a reduced thickness. In addition, since the display electrode terminals 3 are arranged at that edge portion of the display cell 1 which is not adjacent to the electric battery 2, the display pattern can be located at substantially the center of the timepiece as shown in FIG. 1, thereby providing a timepiece which is simple in design and easy to see. The timepiece which is easy to see is provided by the matrix drive display and by the terminals whose number is reduced. Even though the terminals are concentrated at one edge of the display cell, the display electrodes can be spaced apart from each other by a distance which is substantially the same as that of the static drive display electrodes. As a result, it is not necessary to precisely locate the electrode patterns and to reliably connect the electrode patterns to the connecter 12. The total number and density of the wiring patterns at the circuit substrate becomes so reduced that the timepiece can be made small in size without requiring any severe tolerance. In addition, connections between the integrated circuit chip 9 and the substrate pattern become small in number, so that the integrated circuit chip 9 becomes small in size so as to make it less expensive, reduce the bonding steps and make it reliable in operation.

In FIG. 1, reference numeral 13 designates a button adapted to be operated outside the timepiece for the purpose of setting the display to a pitch measuring mode to be described later. In FIG. 2, reference numeral 14 designates an antenna formed of a plate-shaped conductor and for transmitting a pitch signal. The antenna 14 is secured to a rear cover opposed to the display surface of the timepiece. The plate-shaped conductor of the antenna 14 may be modified into a ring-shaped or blind-shaped one. In addition, the plate-shaped conductor of the antenna 14 may be divided into two conductors and these two conductors may be arranged adjacent to each other in a manner similar to an electrode construction for a static drive display cell.

If the timepiece with its display surface facing upwardly is disposed on a pitch measuring pick-up provided with an electric field detection electrode embedded therein or if the timepiece with its display surface facing downwardly after the timepiece has been set to its pitch measuring mode is disposed on the pitch measuring pick-up, the pitch can be easily be measured.

Figure 3:
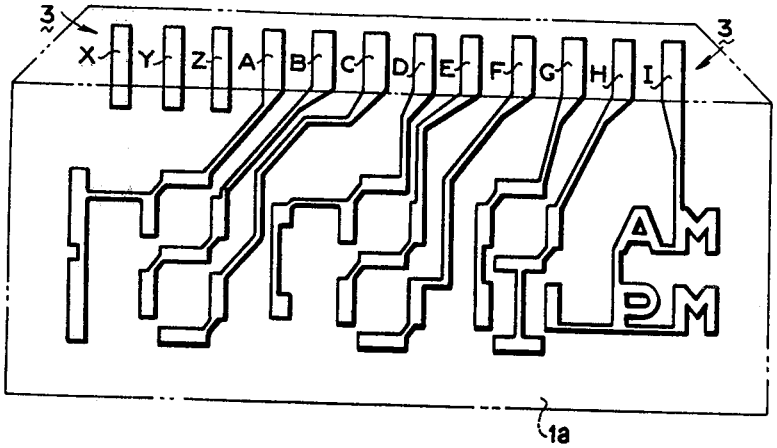
FIGS. 3 and 4 are schematic diagrams of one example of matrix drive electrode patterns.
Figure 4:
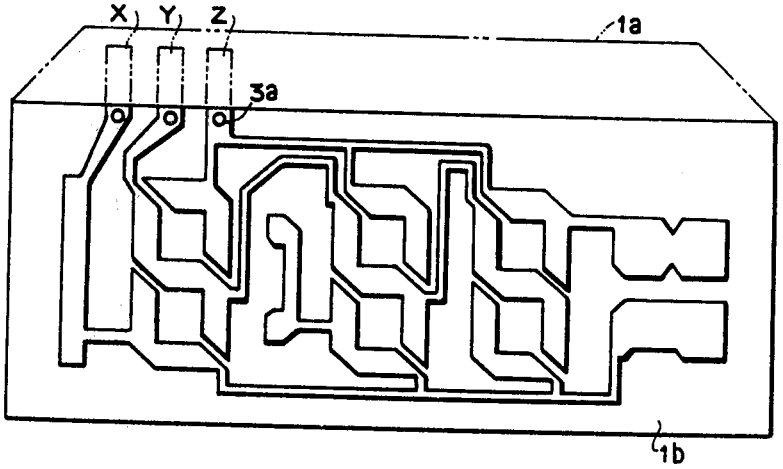

FIGS. 3 and 4 show one example of matrix drive electrode patterns for the sake of reference. All of upper electrode patterns shown in FIG. 3 are provided at the lower surface of the upper substrate 1*a* shown by dashed lines and directly connected to terminals A, B, C, D, E, F, G, H, I of the terminal 3, respectively. These upper electrodes are line electrodes. All of lower electrode patterns shown in FIG. 4 are provided at the upper surface of the lower substrate 16 and connected through silver connection points 3*a* to terminals X, Y, Z of the terminal 3, respectively. These lower electrodes are column electrodes. The total number of the terminals is 12. In the case of the static drive with respect to the same display as the matrix drive, it is required to provide 1 electrode for the common electrode, $1+7x3=22$ electrodes for the numeral segments, 1 electrode for the colon, 1 electrode for AM and 1 electrode for PM, i.e., provide 26 electrodes in total. As a result, even when the number of figures to be displayed is small, it is difficult to arrange the terminals at one side of the display cell. If the number of figures is increased, it is sufficient by 3 for every 7 segments in the case of three column drives.

Figure 5:
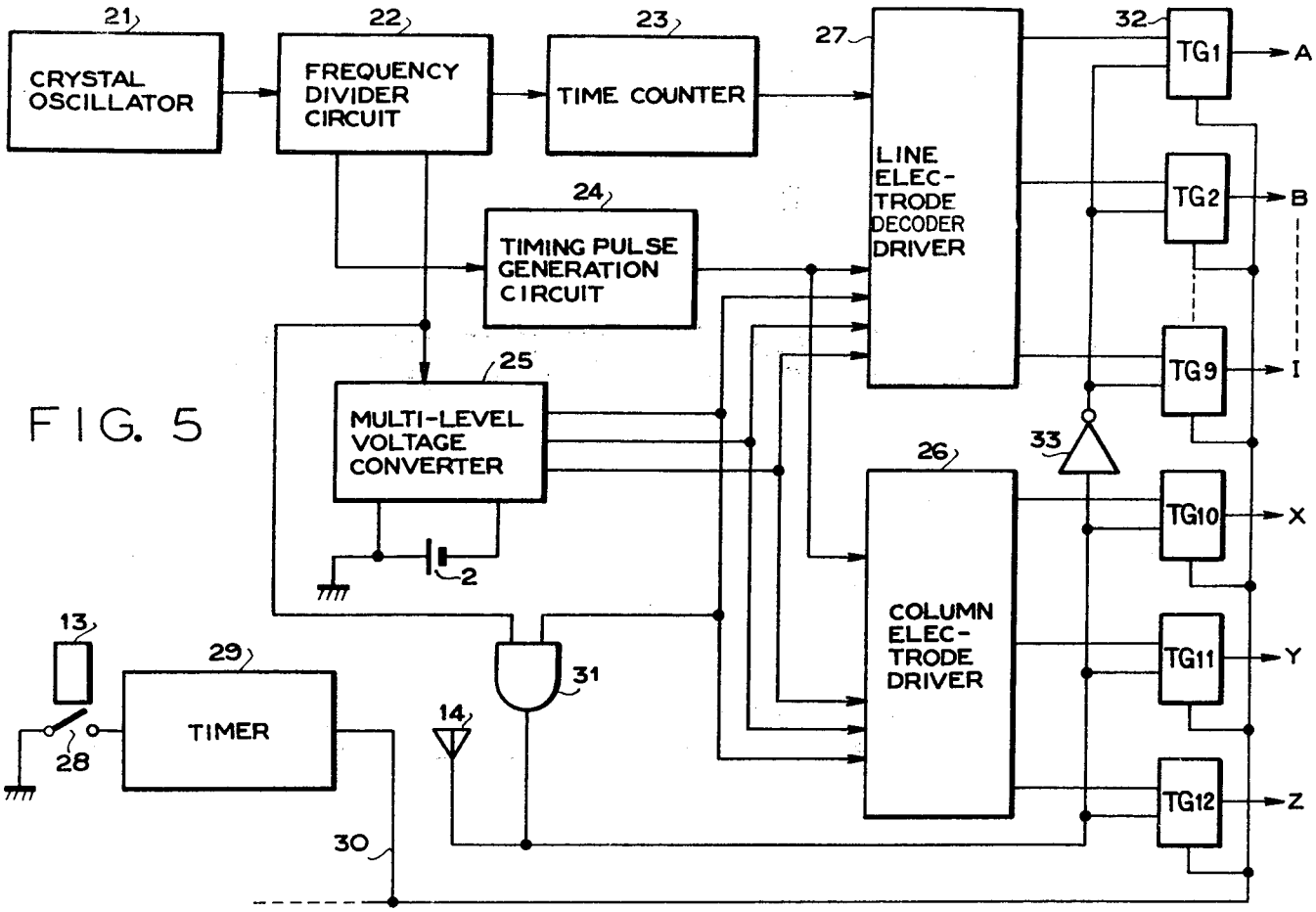
FIG. 5 is a block diagram of one embodiment of a drive circuit for a matrix drive display electronic timepiece according to the invention.

FIG. 5 shows a block diagram of one embodiment of a drive circuit for a matrix drive display electronic wrist watch according to the invention. As is conventional, the main circuit elements are made into an integrated circuit in a monolithic manner. FIG. 5 shows a crystal oscillator 21 for generating a time refernce signal having a frequency of 32768 Hz, for example, a frequency divider circuit 22 for dividing the frequency of the time reference signal to produce a time unit signal which is a time counting signal or which defines the circuit operation. Also shown is a time counter 23 for counting the time unit signal to produce a time counting signal for obtaining a time information, a timing pulse generation circuit 24 connected between the frequency divider circuit 22 and a line electrode decoder driver 27 to be described later and operative to drive a column electrode driver 26 to be described later or the line electrode decoder-driver 27 in phase. A multi-level voltage converter 25 is connected in parallel with the timing pulse generation circuit 24 between the frequency divider circuit 22 and the line electrode decoder-driver 27 and operative to convert one electric source voltage into several electric source voltages, and the column electrode driver 26 is connected to the multi-level voltage converter 25 and operative to combine several voltage levels so as to deliver as an output a column electrode voltage wave adapted to be controlled by the timing pulse delivered from the timing pulse generation circuit 24. The column electrode driver 26 is provided with output terminals connected to the X, Y, Z terminals of the display cell 1 under the normal time display condition in which the matrix drive display is effected. The line electrode driver functions to receive the time counting signal from the time counter 23 and is operative to read out the contents of the time counter 23 and deliver an output line electrode voltage wave in response to the contents thus read out. The output from the line electrode driver 27 is normally delivered to the terminals A-I of the terminals 3. Reference numeral 28 designates a pitch measuring switch operable by the button 13. If the switch 28 is closed, a timer circuit 29 becomes operative to deliver a given output to a conductor 30 for a given time, for example, 1 minute. An AND gate 31 selects an output, preferably one output having a large absolute value from the multi-level voltage converter 25 and modulating the output thus selected with a low frequency output from the frequency divider circuit 22, for example, an output having 32 Hz to produce a rectangular wave voltage signal. An inverter 33 produces an inverted signal from the rectangular wave voltage signal delivered from the AND gate 31. Reference numeral 32 designates twelve transmission gates $TG_1$ to $TG_{12}$ operative to cut out the outputs from the drivers 26, 27 connected to the column or line elctrodes and to connect the output from the AND gate 31 or the output from the inverter 33 to the column or line electrodes.

When the output from the timer 29 is delivered to the conductor 30, the time is no longer displayed. Since all of the column electrodes and line electrodes receive the same voltage wave form as in the case of the static drive, it is possible to measure the pitch. By the arrangement of this embodiment, since counter phase rectangular wave voltages are applied across all the line electrodes A-I and all the column electrodes X-Z, all the segments are in indicative condition as long as the output appears on the line 30. Thus, the pitch measuring condition of the watch can be easily monitored from outside and the arrangement has the advantage that all the indication segments can be easily checked for any trouble. And if the inverter 33 is eliminated, in the pitch measuring condition, all the electrodes are driven with the same phase signals and thus, all the indication disappears completely and thereby making it easy to discern the condition of the segments. In addition, the output terminal of the AND gate 31 is also directly connected to the transmission antenna 14, so that it is also possible to normally measure the pitch. It is a matter of course that the presence of either one of the above two kinds of pitch signal transmitter means is sufficient to measure the pitch. It is not always necessary to provide the pitch measuring mode with the aid of the one push switch 28 and timer 29. If use is made of a switch operable by a selfholding operation member such as a winding stem or the like or if use is made of a jig for maintaining the button 13 in its pushed down condition, it is possible to omit the timer 29. The pitch measuring mode is not usually required, and as a result, the pitch measuring switch 28 may be hidden behind a battery hatch. Alternatively, provision may be made of a switch circuit which causes the pitch measuring switch 28 to be closed only when it is specially operated, for example, it is held closed for at least 10 seconds or is closed only when a combinaton of switches are operated.

The timing pulse generation circuit 24, multi-level voltage converter 25, line electrode driver 26 and column electrode driver 27 in combination function to convert the time keeping signal outputs of the time counter 23 into line electrode and column electrode drive signals and therefore, it can be said that all the components referred to hereinabove may be generally referred to as one embodiment of matrix drive circuit means. The button 13, switch 28, timer 29, AND gate 31, switching gate 32 and inverter 33 act on the above-mentioned matrix drive circuit means to momentarily simplify (static driving in this case) the drive wave forms of the line and column electrodes 3 and send the simplified wave forms to the display devices as pitch signals and therefore, all the compoenents referred to hereinabove are generally referred to as pitch measurement signal transmission means. Furthermore, among the components of the transmission means, since the AND gate 31, switching gate 32 and inverter 33 are directly concerned with the simplification of at least some of the wave forms of drive signal outputs as mentioned above, the three components are generally referred to as drive wave conversion means. The button 13, switch 28 and timer 29 function to provide signals which momentarily cause the drive wave form conversion means to be in operative condition, and are referred to as drive mode switching means.

Figure 6:
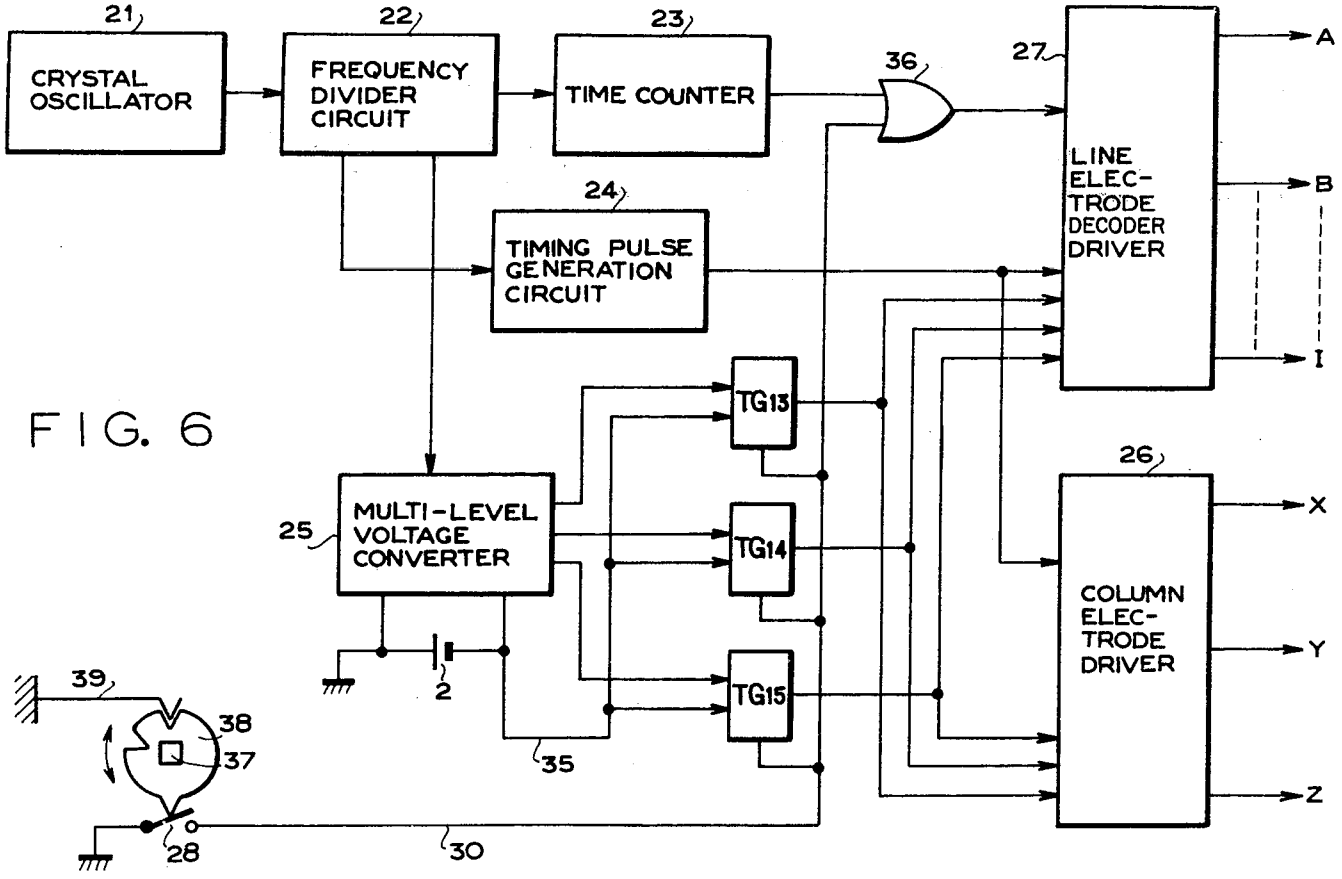
FIG. 6 is a block diagram of another embodiment of a drive circuit for a matrix drive display electronic timepiece according to the invention.

The terms such as matrix drive circuit means, signal transmission means, drive wave form conversion means and drive switching means are given to the components for their respective functions, it is apparent that the present invention is not limited to the arrangement of the illustrated embodiment. In order to clarify this point, the difference of the other embodiments from the embodiment of FIG. 6 referred to hereinabove resides in the provision of the drive wave form conversion means and drive mode switching means. The drive wave form conversion means comprises the transmission gates TG13, TG14 and TG15 and when a drive mode switching output appears on the line 30, the gates prevent passage of the outputs of plural voltage levels of the multi-level voltage converter 25 and instead provide voltages at a constant level to the line electrode driver 26 and column electrode decoder driver 27. As the result, the drive wave forms are inevitably simplified. However, the drive wave forms disturb the indication if the drive wave forms are left as they are and no indication is seen though the wave forms will not interfere with the step measuring operation and thus, the output on the line 30 is input to one side of the OR gate 36. A plurality of OR gates 36 are employed when the time keeping counter 23 provides a plurality of outputs.

In the step measurement mode, all the time keeping outputs are constant and indicated uniformly. The voltages at the above-mentioned predetermined level may be taken out of the terminal of the power source cell 2 of the watch itself as illustrated or any one of the outputs of the multi-level voltage converter 25 may be employed. Such alternation can be attained by connecting the one output employed to the line 35. The drive mode switching means of this embodiment comprises a cam 38 adapted to be rotated by the winding core 37 secured to the watch stem, the switch 28 adapted to be closed when pushed by the projection of the cam 38 and the retaining spring 39 adapted to engage in the recess in the cam 38. The circuit closing can be optionally performed by manual operation and the closing condition of the circuit is maintained unless the operation is reversed to thereby maintain the closing output on the line 30. Thus, the mechanism constitutes one example of self-holding means.

Figure 7:
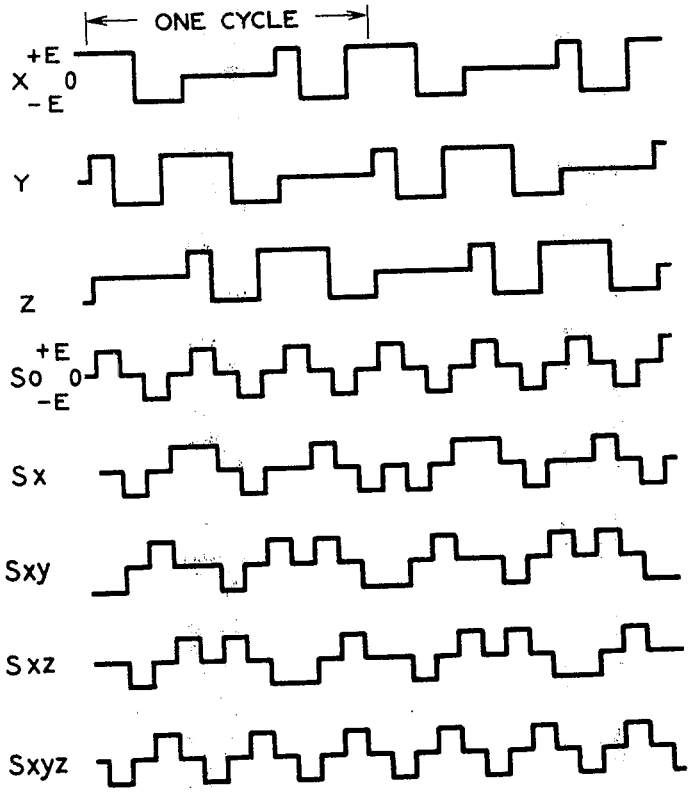
FIG. 7 is one example of complex matrix drive voltage wave forms.

FIG. 7 shows one example of complex matrix drive voltage waves. In the present example, the driving electric source voltage has 3 levels of +E, 0 and −E. FIG. 7 shows 2 periods of the matrix drive voltage waves. In FIG. 7, X, Y, Z show voltage wave forms applied to the first, second and third column line electrodes, respectively. These line electrode voltage wave forms are lagged in phase by $\frac{1}{3}$ period from each other. S shows voltage wave forms applied to respective line electrodes. So shows that line electrode voltage wave form which is applied when all of the segments belonging to the line electrodes are not displayed. Sx shows that line electrode voltage wave form which is applied when only the segment belonging to the X column electrode is displayed, but the remaining segments are not displayed. Sxy shows that line electrode voltage wave form which is applied when the two segments belonging to the X and Y column electrodes are displayed, but the segment belonging to the Z column electrode is not displayed. Sxz shows that line electrode potential wave form which is applied when the segments corresponding to the X and Z column electrodes are displayed, but the segment belonging to the Y column electrode is not displayed. Sxyz shows that line electrode potential wave form which is applied when all of the segments belonging to the X, Y and Z column electrodes are displayed. Any other line electrode voltage wave forms not shown in FIG. 6 may be obtained by lagging in phase by $\frac{1}{3}$ period or $\frac{2}{3}$ period.

Figure 8:
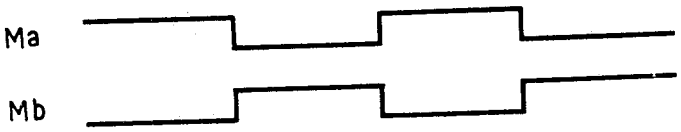
FIG. 8 is an example of voltage wave forms of a display drive signal or a signal supplied to an antenna when the pitch of a timepiece is measured.

FIG. 8 shows simplified drive voltage wave forms applied when the pitch measuring condition is displayed. Ma shows that voltage wave form which is applied to all of the line electrodes. Mb shows that voltage wave form which is applied to all of the column electrodes. These voltage wave forms are the same as those of the static drive for displaying all of the segments. It is not always necessary to display all of the segments. Only one portion of the segments may be displayed and eventually all of the segments may be extinguished. At any rate, it is essential to drive the electrode to be transmitted which, in the present case, corresponds to the display electrode with a relatively simple wave form or with a sharp peak wave form. Similarly, the voltage wave form supplied to the antenna 14 must also be of simplified or sharp peak one.

In order to make the detection sensitivity high, it is preferable to not cover the antenna electrode with a metal portion of a timepiece case. The antenna electrode may eventually be provided at the display surface side. For example, the antenna electrode may be composed of a transparent electrically conductive film coated on the front surface of the display cell 1. Alternatively, the antenna electrode may be composed of a ring-shaped metal electrode surrounding the display surface of the display cell 1.

In a second embodiment of the invention not shown, a signal delivered from the frequency divider circuit 22 shown in FIG. 5 and having a period of 1 second, for example, is differentiated and a wave form thus differentiated is supplied to a high voltage source so as to modulate it and to obtain a spike pulse having a period of 1 second and an extremely narrow width. This spike pulse is applied to the column electrode and an inverted spike pulse is applied to the line electrode. In the present embodiment, the transmission gates 32 are replaced by OR gates which functon to superimpose or insert the above mentioned spike pulse and inverted spike pulse on or into the conventonal matrix drive output. The wave form of those pulses is extremely narrow in width and hence does not cause the display to respond thereto. This wave form, however, rises up suddenly, so that it is possible to detect the pitch by thin wave form.

As stated hereinbefore, the use of the measures according to the invention that provision is made of an antenna conductor for transmitting a pitch signal or of a pitch measuring mode of simplifying a display drive voltage wave form or of means for superimposing that pitch signal to which the display does not respond on the display drive voltage provides the important advantage that a matrix drive display electronic timepiece can easily detect its pitch. The concepts of this invention can also be efficiently applied to a timepiece provided with either one of various kinds of electronic optical display devices such as an electro-chromic display device other than a liquid crystal display device, elastomer display device, light emitting diode display device, high dielectric ceramic display device, etc. In addition, the invention can be applied to a quasi-analog timepiece which can electronically display analog time positions.

What is claimed is:

1. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) a time keeping counter counting said time unit signals to provide a time keeping signal;

(f) matrix drive circuit means converting said time keeping signal into drive signals for said line and column electrodes, said matrix drive circuit means comprising a voltage converter providing multi-level voltages for driving said line and column electrodes by employment of said single voltage level power source as the energy source, timing signal generation means receiving the output from a portion of said frequency divider circuit as the input and providing a matrix drive timing signal as the output, a line electrode drive switching said multi-level voltages with said timing signal to form output wave forms which are selectively indicative and non-indicative of said line electrodes, and a column electrode driver switching said multi-level voltages with said timing signal and time keeping signal to form a column electrode drive wave; and (g) pitch measurement signal transmission means including conversion means for converting at least some of said line and column electrode drive signals into the same wave form and drive mode switching means for producing a signal for momentarily operating said conversion means.

2. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) a time keeping counter counting said time unit signals to provide a time keeping signal;

(f) matrix drive circuit means converting said time keeping signal into drive signals for said line and column electrodes and including a voltage converter providing multi-level voltages for driving said line and column electrodes by employment of said single voltage level power source as the energy source; and (g) pitch measurement signal transmission means including drive wave conversion means for converting at least some of said line and column electrode drive signals into the same wave form and drive mode switching means for producing a signal for momentarily operating said conversion means, said drive wave conversion means comprising switching circuit means converting said multi-level voltage into a single level voltage.

3. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) a time keeping counter counting said time unit signals to provide a time keeping signal;

(f) matrix drive circuit means converting said time keeping signal into drive signals for said line and column electrodes; and (g) pitch measurement signal transmission means for converting a portion of said drive signal of said display device into a static drive including conversion means for converting at least some of said line and column electrode drive signals into the same wave form and drive mode switching means for producing a signal for momentarily operating said conversion means.

4. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) a time keeping counter counting said time unit signals to provide a time keeping signal;

(f) matrix drive circuit means converting said time keeping signal into drive signals for said line and column electrodes; and (g) pitch measurement signal transmission means including conversion means for converting at least some of said line and column electrode drive signals into the same wave form and drive mode switching means for producing a signal for momentarily operating said conversion means, said drive mode switching means comprising switch means and timer circuit means.

5. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) atime keeping counter counting said time unit signals to provide a time keeping signal;

(f) matrix drive circuit means converting said time keeping signal into drive signals for said line and column electrodes; and (g) pitch measurement signal transmission means including conversion means for converting at least some of said line and column electrode drive signals into the same wave form and drive mode switching means for producing a signal for momentarily operating said conversion means, wherein said drive mode switching means comprises self-hold switching means.

6. An electronic watch comprising:

(a) a single voltage level power source serving as the energy source for said watch;

(b) a matrix drive type liquid crystal display device providing digital indications of times by means of line and column electrodes;

(c) a crystal oscillator producing a time reference signal;

(d) a frequency divider circuit dividing said time reference signal into time unit signals;

(e) a time keeping counter counting said time unit signals to provide a time keeping signal;

(f) matrix drive circuit means converting said time keeping signal into drive signals for said line and column electrodes, wherein a portion of said line and column electrode drive signals, having the same wave form, have a static drive wave form; and (g) pitch measurement signal transmission means including conversion means for converting at least some of said line and column electrode drive signals into the same wave form and drive mode switching means for producing a signal for momentarily operating said conversion means.

* * * * *